9/16/86 XR 4,611,856

United States Patent [19]

Cha et al.

[11] Patent Number: 4,611,856

[45] Date of Patent: Sep. 16, 1986

[54] TWO-LEVEL, HORIZONTAL FREE FACE MINING SYSTEM FOR IN SITU OIL SHALE RETORTS

[75] Inventors: Chang Y. Cha; Thomas E. Ricketts, both of Bakersfield, Calif.

[73] Assignee: Occidental Oil Shale, Inc., Grand Junction, Colo.

[21] Appl. No.: 533,267

[22] Filed: Sep. 16, 1983

Related U.S. Application Data

[63] Continuation of Ser. No. 246,232, Mar. 23, 1981, abandoned, which is a continuation of Ser. No. 70,319, Aug. 27, 1979, abandoned.

[51] Int. Cl.[4] ..... E21C 41/10

[52] U.S. Cl. ..... 299/2; 299/13

[58] Field of Search ..... 299/2, 13, 19; 166/299

[56] References Cited

U.S. PATENT DOCUMENTS

| | | | |
|---|---|---|---|
| 2,481,051 | 9/1949 | Uren | 299/2 |
| 3,001,776 | 9/1961 | Van Poollen | 299/2 |
| 3,537,753 | 11/1970 | Arendt | 299/13 |
| 3,586,377 | 6/1971 | Ellington | 299/2 |
| 3,917,346 | 11/1975 | Janssen | 299/13 |
| 4,017,119 | 4/1977 | Lewis | 299/2 |
| 4,043,597 | 8/1977 | French | 299/2 |
| 4,109,964 | 8/1978 | Ridley | 299/2 |
| 4,118,071 | 10/1978 | Hutchins | 299/2 |
| 4,153,298 | 5/1979 | McCarthy et al. | 299/2 |
| 4,167,291 | 9/1979 | Ridley | 299/2 |
| 4,269,449 | 5/1981 | del Rio | 299/2 |
| 4,378,949 | 4/1983 | Miller | 299/2 |

FOREIGN PATENT DOCUMENTS 1012564 6/1977 Canada .

OTHER PUBLICATIONS

SME Mining Engineering Handbook, vol. 1, Arthur B. Cumming et al., (SME, NY, NY, 1973) pp. 12-135 to 12-150, 12-162 to 12-233.

"The Application of Spherical Charge Technology in Stope and Pillar Mining" by L. C. Lang-Eng. & Mining Journal, 5-1976.

*Primary Examiner*—James A. Leppink
*Assistant Examiner*—Hoang C. Dang
*Attorney, Agent, or Firm*—Christie, Parker & Hale

[57] ABSTRACT

A subterranean formation containing oil shale is prepared for in situ retorting by forming a fragmented permeable mass of formation particles containing oil shale in an in situ retort site. The retort is formed by excavating a lower level drift adjacent a lower portion of the retort site and excavating an upper level void adjacent an upper portion of the retort site. An undercut is excavated below a zone of unfragmented formation remaining within the retort site above the lower level drift. The undercut can be free of roof-supporting pillars. Explosive is loaded in the zone of formation from access provided by the upper void, and the zone of formation is blasted downwardly toward the undercut for forming the fragmented mass. The volume of the void space within the undercut prior to explosive expansion is similar to the void volume within the principal portion of the fragmented mass being formed. The zone of formation is blasted downwardly in lifts, with each lift being blasted toward a void space larger than a limited void, except for the last lift, which can be blasted toward a limited void. Blasting designs are also disclosed for providing reasonably uniform void fraction distribution in the fragmented mass.

31 Claims, 12 Drawing Figures

TWO-LEVEL, HORIZONTAL FREE FACE MINING SYSTEM FOR IN SITU OIL SHALE RETORTS

CROSS REFERENCE TO RELATED APPLICATIONS

This is a continuation of application Ser. No. 246,232, filed Mar. 23, 1981, which, in turn, is a continuation of application Ser. No. 070,319, filed Aug. 27, 1979 both now abandoned.

BACKGROUND

This invention relates to in situ recovery of shale oil, and more particularly to a mining system for excavation and explosive expansion of oil shale formation in preparation for forming an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is call "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; and 4,043,598, which are incorporated herein by this reference. These patents describe in situ recovery of liquid and gaseous hydrocarbon materials from a subterranean formation containing oil shale, wherein such formation is explosively expanded for forming stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material.

The liquid products and the gaseous products are cooled by the cooled oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

It is desirable to form a fragmented mass having a reasonably uniformly distributed void fraction, i.e., a fragmented mass of reasonably uniform permeability, so that retorting gas can flow generally uniformly through the fragmented mass during retorting operations. Techniques used for excavating void spaces in a retorting site and for explosively expanding formation toward the voids can affect the uniformity of particle size or permeability of the fragmented mass. A fragmented mass having reasonably uniform permeability in horizontal planes across the fragmented mass can avoid bypassing portions of the fragmented mass by retorting gas, which can otherwise occur if there is gas channeling through the fragmented mass owing to non-uniform permeability.

It is desirable that techniques used in excavating and explosively expanding formation within an in situ oil shale retort site provide a means for controlling the void fraction distribution within a fragmented mass being formed so that a reasonably uniformly distributed void fraction can be provided in the resulting fragmented mass.

U.S. Pat. No. 4,043,597 discloses a method for forming a fragmented mass, in which a zone of unfragmented formation within a retort site can be explosively expanded in lifts, i.e., in separate horizontal layers with a time delay between expansion of each layer. If expansion of such lifts is not carefully controlled, non-uniform void fraction distribution within the fragmented mass can result. This can lead to channeling of gas flow through the fragmented mass during subsequent retorting operations. The mining system of this invention facilitates control over the void fraction distribution in a fragmented mass being formed.

U.S. Pat. Nos. 4,043,597 and 4,043,598 disclose methods for forming a fragmented mass in a horizontal free face system with intermediate level voids. The mining and construction costs involved in preparing a retorting site for explosive expansion can be reduced by eliminating excavation of multiple voids and corresponding retort level access drifts at intermediate levels of a retort site. Elimination of such intermediate void spaces from a retort can avoid the presence of large unsupported areas within a retort site where workmen can be present during mining operations. The present invention facilitates use of a two-level, horizontal free face mining system in which a fragmented mass can be formed without excavating multiple void spaces and corresponding retort level access drifts at different intermediate levels within a retort site. In the present system the need for workers being present in the void spaces within the retort site is avoided.

SUMMARY OF THE INVENTION

According to one embodiment of this invention, a lower level drift is excavated adjacent a lower portion of an in situ oil shale retort site, and an upper level void is excavated above the retort site. An undercut is excavated in a lower portion of the retort site adjacent the lower level drift, leaving a remaining zone of unfragmented formation within the retort site above the undercut. The undercut can be free of roof-supporting pillars. Explosive is placed in the remaining zone of formation from access provided by the upper void. The zone of formation is explosively expanded in lifts in a plurality of sequential horizontal layers from the bottom up for forming a fragmented permeable mass of formation particles containing oil shale within the retort site. The void volume provided by the undercut prior to to explosive expansion is similar to the volume of void spaces present in the principal portion of the resulting fragmented mass.

Preferably the formation above the undercut is explosively expanded in layers with at least a portion of the layers expanded towards an essentially unlimited void.

The zone of unfragmented formation can be explosively expanded downwardly in separate lifts, by placing explosive in a lower horizontal layer of formation and detonating the explosive in the lower layer prior to placing explosive in an adjacent upper layer and detonating the explosive in the upper layer.

Alternatively, the zone of unfragmented formation can be explosively expanded in lifts by deck loading explosive charges in the horizontal layers to be expanded and detonating the deck loaded charges in a single round of explosions. Time delays between blasting of each lift can be sufficiently long to create a new free face after blasting such a lift, but the time delay can be sufficiently short to inhibit substantially free expansion of formation particles within the lift being expanded.

The lifts can be blasted in layers of progressively reduced thickness, with each successive lift having explosive charges with progressively reduced quantity of explosive.

Pre-splitting charges also can be placed adjacent the perimeter of the retort site for presplitting formation within the retort site prior to explosively expanding the zone in lifts.

Detonation of explosive can be initiated at one or more different locations within the horizontal cross-section of adjacent lifts in each lift for controlling void fraction distribution in the resulting fragmented mass.

DRAWINGS

These and other aspects of the invention will be more fully understood by referring to the following detailed description and the accompanying drawings in which:

FIG. 1 is a fragmentary, semi-schematic vertical cross-section illustrating an in situ oil shale retort site at an initial stage of development according to principles of this invention;

DETAILED DESCRIPTION

Figure 2:
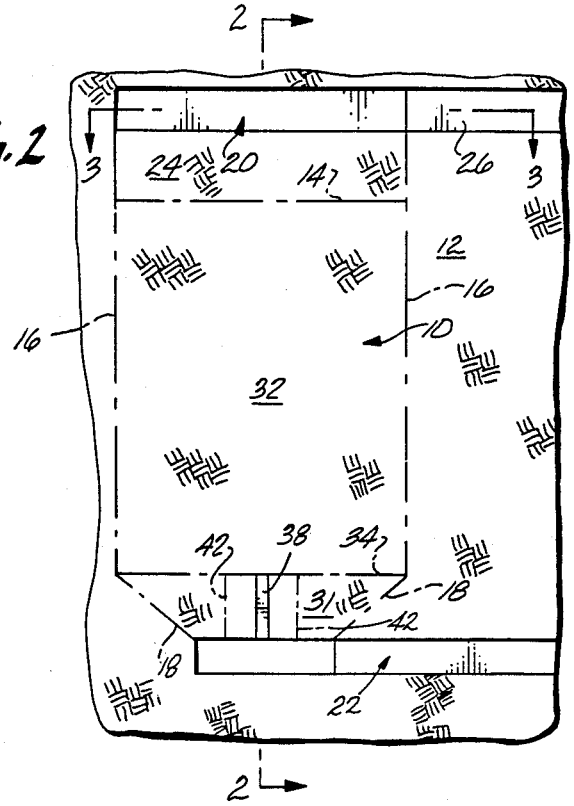
FIG. 2 is a fragmentary, semi-schematic vertical cross-section taken on line 2—2 of FIG. 1.
Figure 2:
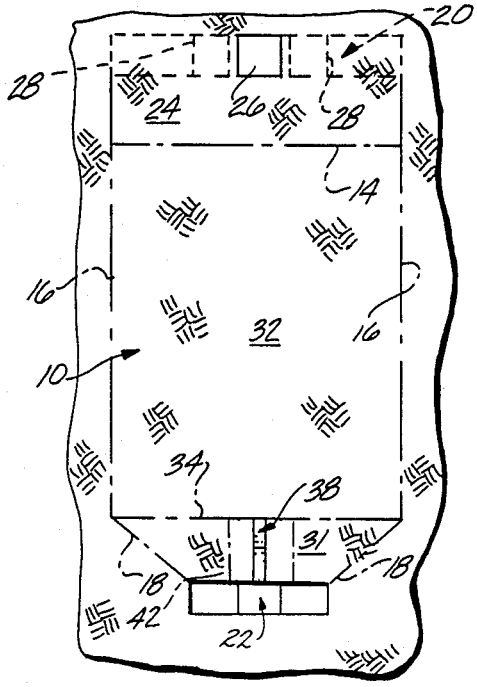
Figure 3:
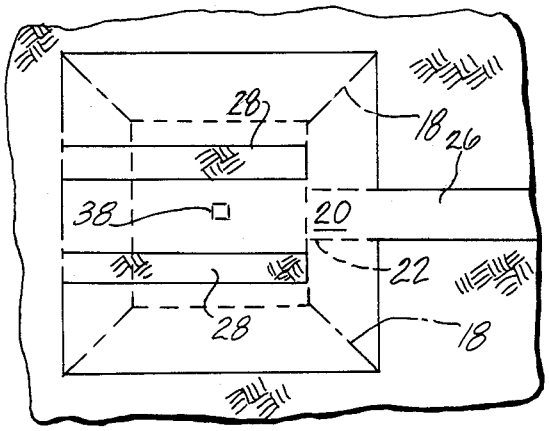
FIG. 3 is a fragmentary, semi-schematic horizontal cross-section taken on line 3—3 of FIG. 1.

FIGS. 1 through 3 schematically illustrate an initial stage of development of an in situ oil shale retort being formed in accordance with principles of this invention. The in situ retort is formed in a retort site 10 in a subterranean formation 12 containing oil shale. The in situ retort illustrated in FIGS. 1 through 3 is rectangular in horizontal cross-section, having a horizontal top boundary 14, four vertically extending side boundaries 16, and four downwardly and inwardly converging lower boundaries 18 that form a tapered lower portion of the retort being formed.

The in situ retort illustrated in the drawings is formed by a two-level mining system which includes an upper level void 20 excavated horizontally above the retort site, and a lower level drift 22 excavated horizontally across a lower retort level adjacent a lower portion of the retort site.

In the illustrated embodiment, the upper level void 20 provides an open base of operation above the retort site. The floor of the base of operation is spaced above the upper boundary of the retort being formed, leaving a horizontal sill pillar 24 of unfragmented formation between the floor of the base of operation and the upper boundary of the retort being formed. The base of operation is excavated by access provided by an upper level access drift 26 excavated on the same level as the floor of the base of operation. A pair of horizontally spaced apart pillars 28 of unfragmented formation are left within the base of operation for providing temporary roof support for overburden above the base of operation. The support pillars form a generally E-shaped base of operation when the base of operation is viewed in the plan view of FIG. 3. The horizontal cross-section of the base of operation is similar to the horizontal cross-section of the retort being formed. The base of operation can provide effective access to substantially the entire horizontal cross-section of the retort being formed. The base of operation provides access for drilling and explosive loading for subsequently explosively expanding formation within the retort site for forming a fragmented permeable mass 30 of formation particles containing oil shale (see FIG. 11) within the upper, side and lower boundaries of the retort. The base of operation also facilitates introduction of oxygen-supplying gas such as air into the top of the fragmented mass formed below the sill pillar, and for this reason the base of operation also can be referred to as an air level void.

The lower level drift 22 extends below the retort site and terminates at generally the bottom center of the retort being formed. The portion of the lower level drift at the bottom center of the retort can be enlarged in horizontal cross-section, as shown in the drawings for providing a larger area for fluid flow than provided solely by the drift. The sloping lower boundaries 18 of the retort converge downwardly toward the end of the lower level drift, i.e., where the drift terminates at the bottom center of the retort being formed. The sloping lower boundaries 18 define a tapered lower portion 31 of the retort which is shaped generally as an inverted pyramid of rectangular cross-section. A principal upper portion 32 of the retort is formed within the four vertical side boundaries 16 of the retort. The principal upper portion of the retort is of uniform rectangular cross-sectional configuration from the upper boundary 14 down to a horizontal lower level 34 below which the retort tapers downwardly and inwardly toward the end of the lower level drift.

In the exemplary embodiment illustrated in the drawings, the retort being formed is square in horizontal cross-section within the principal upper portion 32 of the retort. If desired the horizontal cross-section can be rectangular with greater length than width and suitable changes in the detail at the top and bottom are made. For example, other shapes of air level bases of operation can be excavated for effective access to the horizontal cross-section of the retort and two or more drifts can be excavated at the lower production level for access to the bottom.

An undercut is excavated within the lower portion of the retort below unfragmented formation remaining within an upper portion of the retort site. The undercut is formed, in part, by a downwardly and inwardly tapered void space 36 (see FIG. 7) initially formed within the tapered lower boundaries 18 of the retort site. FIGS. 1 through 3 depict stages of development of the tapered void, in which a vertical raise 38 is initially excavated between the roof of the lower level drift 22 and the level 34 corresponding approximately to the top of the sloping lower boundaries of the retort. As illustrated best in FIG. 3, the raise is excavated along the vertical centerline of the retort. In one embodiment, the raise is square in horizontal cross-section, with each side of the raise being approximately eight feet wide. If desired, the raise can be bored by drilling from the base of operation and drawing a raise drill upwardly along the resultant pilot hole. Blasting can enlarge the round bored raise to a square cross-section.

The initial raise 38 is then enlarged in horizontal cross-section to form an enlarged raise 40 (see FIG. 4) approximately the same height as the initial raise. The enlarged raise is formed by explosively expanding formation toward the free faces adjacent the initial raise and the end of the lower level drift. The initial raise is preferably enlarged by ring drilling vertical blasting holes (not shown) within boundaries 42 (shown in FIGS. 1 and 2) surrounding the initial raise. Explosive is placed in these blasting holes and detonated for explosively expanding formation within the boundaries 42 toward the initial raise and toward the end of the lower level drift. Fragmented formation particles formed as a result of blasting the enlarged raise are withdrawn from the lower portion of the raise through the lower level drift.

The void space provided by the enlarged raise provides vertical free faces toward which formation within the tapered lower portion 31 of the retort site is explosively expanded for forming the tapered void space 36.

Figure 4:
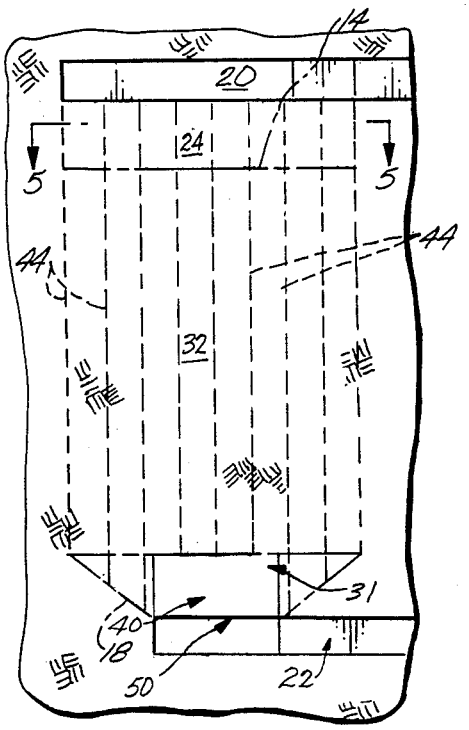
FIG. 4 is a fragmentary, semi-schematic vertical cross-section similar to FIG. 1 and showing a further stage of development in preparation for forming an undercut in a lower portion of the in situ retort site.
Figure 9:
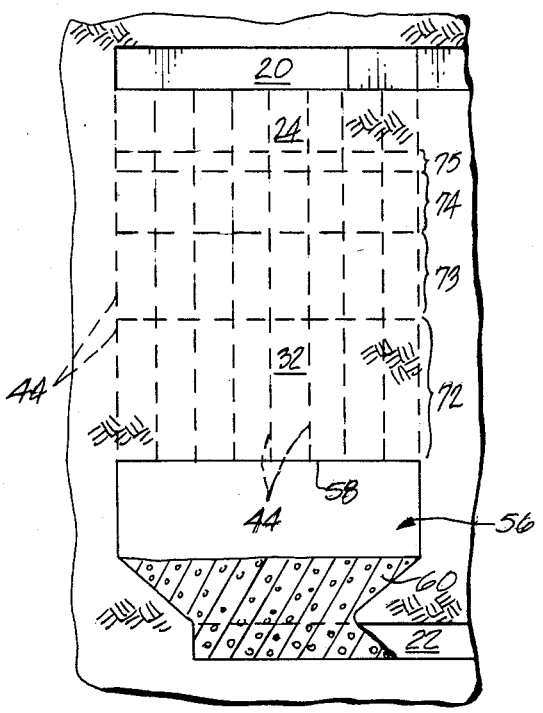
FIG. 9 is a fragmentary, semi-schematic vertical cross-section showing an alternative method of explosively expanding formation within the retort site in lifts of varying thickness.

Blasting holes are drilled within the side boundaries of the retort site for explosive loading in preparation for explosively expanding formation within the retort site to form the fragmented mass 30 illustrated in FIG. 9. In the illustrated embodiment, a plurality of mutually spaced apart vertical blasting holes 44 are drilled downwardly from the base of operation 20 to the lower boundaries of the retort site. The blasting holes are preferably drilled on a square pattern illustrated best in FIG. 5, in which the blasting holes are equidistantly spaced apart in parallel rows extending across the horizontal cross-section of the retort site. As best illustrated in FIG. 4, the blasting holes drilled in the lower portion 31 of the retort site are drilled to progressively different depths to match the tapering lower boundaries of the retort being formed.

For forming the tapered void space 36, lower portions of the blasting holes extending through the tapering lower portion 31 of the retort site are loaded with explosive (not shown) from access provided by the upper void, and at least portions of the blasting holes in the principal upper portion 32 of the retort site are stemmed with an inert material such as sand or gravel. Explosive in the lower portions of the blasting holes is then detonated, preferably in a single round. This explosively expands formation within the lower portion of the retort site toward the free faces adjacent the enlarged raise 40 and toward the free face provided by the enlarged end portion of the lower level drift. This forms a first fragmented permeable mass 46 of formation particles within downwardly and inwardly tapered bottom walls 48 of the retort.

If desired angled blasting holes can be fan drilled from the enlarged region at the end of the lower level drift along the sloping bottom boundary of the retort. Detonation of explosive in such holes helps smooth the bottom boundary of the retort for enhancing withdrawal of fragmented formation as an undercut void is formed. Such detonation can precede the blasting to explosively expand formation towards the expanded raise or can be in a single round therewith.

Figure 5:
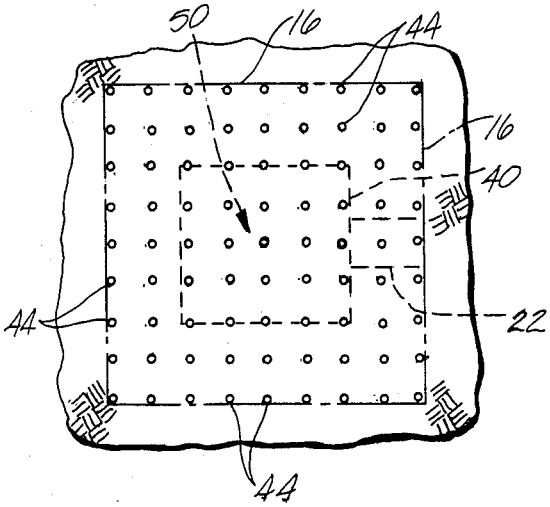
FIG. 5 is a fragmentary, semi-schematic horizontal cross-section taken on line 5—5 of FIG. 4.

An opening 50 is formed in a generally horizontal plane where the sloping bottom walls 48 of the retort converge to the enlarged portion of the lower level drift. In the illustrated embodiment, the opening, which is hereinafter also referred to as a draw point, is rectangular in horizontal cross-sectional configuration, as best illustrated in FIG. 5.

Explosive expansion for forming the tapered void space 36 forms a generally horizontal first free face 52 extending across the bottom of a zone of unfragmented formation remaining within the principal upper portion 32 of the retort site. The void space 36 and horizontal free face 52 extend across substantially the entire horizontal cross-section of the retort site and are free of roof supporting pillars. Such pillars can be avoided despite a wide unsupported span since the excavation and retort forming technique do not require that personnel enter the space beneath the unsupported span.

The void space toward which formation within the lower portion of the retort site is explosively expanded for forming the tapered void space is of sufficient void volume that the space does not bulk full with formation particles following such explosive expansion. This is accomplished by explosively expanding such formation into a void volume which is greater than a limited void volume.

By a limited void volume is meant that the void volume toward which such formation is expanded is smaller than the volume required for free expansion of oil shale formation. When formation is explosively expanded toward an unlimited void, the resulting fragmented mass of particles can reach a certain maximum void fraction due to free or unconstrained expansion. When explosively expanded toward a limited void particles can interact with adjacent walls of unfragmented formation or other expanding formation and be restricted in the total expansion, resulting in a void fraction less than possible by free expansion. If the total available void volume toward which formation is expanded is less than required for free expansion, clearly the voids distributed in the resulting fragmented mass can have no more total volume than the original void and the void fraction is less than possible due to free expansion. It is also found in some cases that the void volume in the fragmented mass is less than the available void due to interactions during expansion and the fragmented mass does not bulk up enough to completely fill the available space. It is also found in some geometric configurations that interactions can limit the void fraction to less than possible by free expansion when the available void volume would appear large enough to accommodate free expansion. These can also be considered to be limited voids.

For example, when the void volume toward which formation is explosively expanded is less than about 35% of the total volume of the void plus the volume of the zone of formation being explosively expanded, then such explosive expansion is toward a limited void volume.

Figure 6:
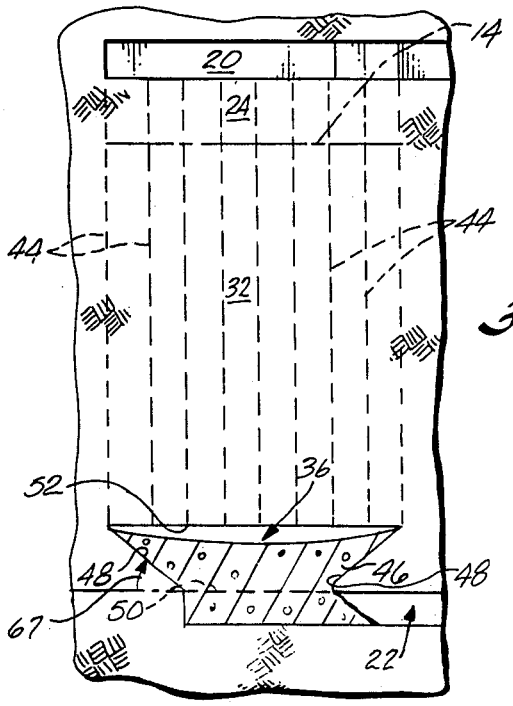
FIG. 6 is a fragmentary, semi-schematic vertical cross-section showing a stage of development in which fragmented formation particles have been explosively expanded toward the undercut.

In the illustrated embodiment, explosive expansion of formation in the lower portion of the retort site is toward a void volume which is greater than about 35%, and the first fragmented mass does not bulk full below the first free face 52. As shown in FIG. 6, there is a narrow void space 36 left within the tapered void between the top surface of the first fragmented mass 46 and the first free face.

Figure 7:
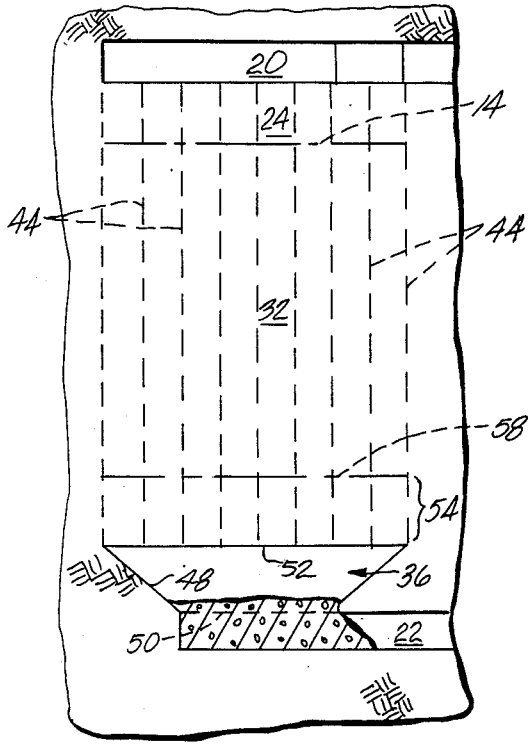
FIG. 7 is a fragmentary, semi-schematic vertical cross-section showing a stage of development in which fragmented formation particles have been removed from the undercut.

After the first fragmented mass 46 is formed within the tapered lower portion of the retort, a portion of the formation particles within the first fragmented mass is withdrawn from the tapered void space 36, through the draw point 50 in the lower level drift, to draw down the top level of formation particles to the level shown in FIG. 7. This provides a desired void volume below the first free face 52. A horizontal lower layer of formation 54 of generally uniform thickness in the lower portion of the principal zone of unfragmented formation 32 is explosively expanded downwardly toward the void space below the first free face 52. The upper level of the lower layer 54 is illustrated by the phantom line at 58 shown in FIG. 7.

This forms an undercut 56 below a zone of unfragmented formation 32' (see FIG. 8) remaining within the principal upper portion of the retort site. The undercut can be free of roof-supporting pillars for the overlying zone of unfragmented formation. By such explosive expansion, a new free face 58, also referred to as a principal free face, is formed below the remaining zone 32 of unfragmented formation. The void space toward which the lower layer 54 is expanded has a sufficient void volume to provide substantially free expansion of formation particles expanded downwardly from said lower layer so that the fragmented mass produced in the lower portion of the retort site does not bulk full below the principal free face.

After the undercut 56 is formed below the principal free face, at least a portion of the formation particles remaining within the lower portion of the retort site is withdrawn through the draw point in the lower level drift to provide a desired void volume within the undercut below the principal free face. The void volume provided within the undercut 56 prior to explosive expansion of formation within the principal zone 32' is similar to the volume of void spaces to be provided in the principal portion of the fragmented mass 30 following such explosive expansion. That is, substantially the entire void fraction of the resulting fragmented mass is provided by the void volume within the undercut prior to explosive expansion for forming the fragmented mass. In one embodiment, the thickness of the lower layer of unfragmented formation is about 30% to 35% of the entire height of the zone of unfragmented formation within the principal upper portion 32 of the retort site. Following explosive expansion of the lower layer 54, the resulting fragmented mass below the principal free face is drawn down so the void space left within the undercut 56 occupies the volume initially occupied by the lower layer 54. Stated another way, the fragmented mass is drawn down to generally the level at which the lower portion of the retort begins to taper, and therefore the void space left below the principal free face is generally uniform in height and width. A void with a uniform height across the entire width of the retort can aid in providing a uniform void fraction in the fragmented mass. If desired, additional layers can be explosively expanded to provide the desired total volume in the undercut.

Rock fragmentation tests have indicated that oil shale formation explosively expanded toward an unlimited void volume has a void fraction of about 35% in the resulting fragmented mass. Formation within the retort site is explosively expanded downwardly principally toward an unlimited void volume provided in the undercut 56, and owing to such free expansion toward an unlimited void volume, the void volume provided within the undercut is sufficient to accommodate substantially free expansion of the overlying formation being blasted toward the undercut. In one embodiment, the volume of the void space left in the undercut below the principal free face is about 30% to 35% of the total volume of formation being expanded plus the void space within the undercut prior to blasting. Thus if the retort is completely full, the average void fraction in the fragmented mass is about 30% to 35%.

The undercut can be formed so that the tapered bottom walls of the retort are on an angle similar to the approximate natural angle of slide of fragmented formation particles containing oil shale. In the illustrated embodiment, each tapered bottom wall extends on an angle of approxlmately 38° to 42° relative to a horizontal plane through the wall, as represented by the angle at 67 in FIG. 6. A steeper angle can be used if desired to maintain a reasonably flat upper surface on the mass of particles left in the retort. By forming the tapered bottom walls near the natural angle of slide of fragmented oil shale, and by using a reasonably wide draw point at the bottom, the top surface of the fragmented mass can remain reasonably level as formation particles are being drawn downwardly through the draw point. In some instances, several horizontally spaced apart draw point openings can be formed at the lower level to assist in maintaining a reasonably level top surface of the fragmented mass.

After the desired void volume is provided in the undercut, the zone 32' of unfragmented formation remaining within the principal upper portion of the retort site is explosively expanded downwardly in lifts. That is, the remaining zone is expanded downwardly by explosively expanding separate horizontal layers of formation of generally uniform thickness in an upwardly progressing time delay sequence within the zone being expanded. Explosive expansion of each lift progressively forms a separate new horizontal free face in such an upwardly progressing sequence. Such new horizontal free faces are represented in phantom lines at 62 in FIG. 8. In the illustrated embodiment, there are four horizontal layers, or lifts, within the zone of unfragmented formation being expanded downwardly for forming the fragmented mass, although the number of lifts and their thickness can differ. In an exemplary embodiment, the height of the void space provided by the undercut is approximately 70 to 90 feet, and the height of the remaining zone 32' of unfragmented formation between the principal free face 58 and the upper boundary 14 is approximately 160 to 180 feet for providing the desired void faction of 30% to 35% in the resulting fragmented mass. In such an embodiment, the thickness of each lift is approximately 40 to 45 feet.

Explosive expansion of each lift forms separate layers of formation particles within the fragmented mass 30 in a upwardly progressing sequence. Each layer of formation within a lift is expanded downwardly toward an essentially unlimited void, except for the last or uppermost lift which can be expanded toward a limited void. Thus, for example, the first lift 40 to 45 feet thick is expanded toward a void 70 to 90 feet high. The proportion decreases as the original undercut volume is depleted by filling with fragmented formation.

The thickness of the uppermost lift can be differed somewhat from the others depending upon the volume of the void space toward which the uppermost layer is expanded. The volume of the void space toward which the uppermost lift is expanded can be measured by determining the level of the top of the fragmented mass and the level of the horizontal free face below the uppermost lift. These measurements can be taken by access provided to them from the base of operation via remaining portions of the blasting holes. By providing a void fraction of approximately 25% for expansion of the uppermost lift, expansion can be toward a limited void, and the top of the fragmented mass can bulk nearly full below the sill pillar 24.

Figure 12:
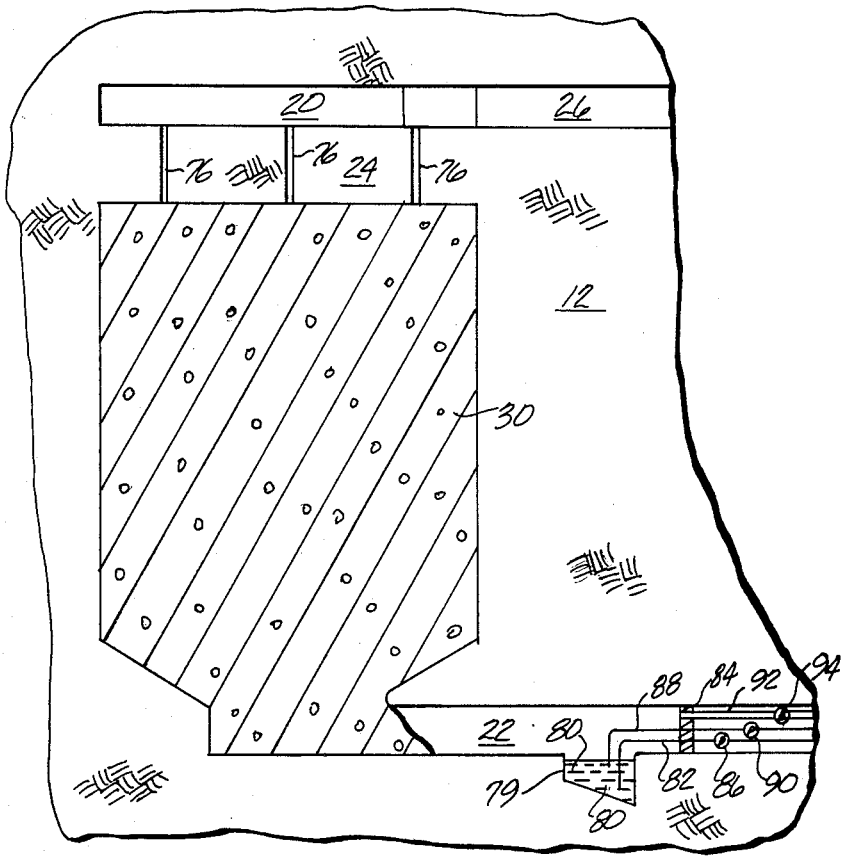
FIG. 12 is a fragmentary, semi-schematic vertical cross-section showing a completed in situ oil shale retort prepared according to principles of this invention.

In one alternative embodiment, the layer of formation forming the horizontal sill pillar can be explosively expanded toward the upper air level void as a final step in forming a fragmented mass. Thus, the upper level void provides a portion of the void space for the resulting fragmented mass. The sill pillar at least in part can be blasted down toward any void space above the top of the fragmented mass as well as up toward the upper level void. In this embodiment, oxygen-supplying gas can be introduced to the top of the fragmented mass from the side of the retort during retorting operations, instead from above as illustrated in FIG. 12 or an auxiliary air level drift can be provided above the retort site for introduction of air during retorting.

Unfragmented formation within the retort site can be explosively expanded toward the undercut in lifts using relatively longer cycle times between lifts, referred to herein as the separate lift method, or using relatively shorter time delays between lifts, referred to herein as dynamic expansion techniques.

In the separate lift method, explosive is placed in a lowermost layer 64 of unfragmented formation and detonated for explosively expanding the lowermost layer downwardly toward the unlimited void volume provided in the undercut 56 for forming a lower portion of the fragmented mass 30. A second layer 66 of unfragmented formation is then loaded with explosive and the explosive is detonated for explosively expanding the second layer to form a further portion of the fragmented mass. These steps are repeated for a third layer 68 of unfragmented formation and for a fourth or uppermost layer 70 of unfragmented formation. Prior to expanding the uppermost layer, care is taken to ensure that expansion is toward a limited void volume so so that the void left above the fragmented mass, following explosive expansion of the uppermost layer, is either minimal or the retort is bulked full to provide support for the overlying sill pillar 24.

In carrying out the separate lift method, for each lift, the bottoms of the blasting holes are grouted or plugged by a suitable means, the lower portions of the blasting holes are stemmed, vertical column charges of explosive are loaded into the portions of the blasting holes in the upper half of the layer of formation being expanded, and at least a part of the remaining upper portions of the blasting holes are stemmed. Thus, an array of explosive charges is distributed across the horizontal cross-section of the layer being blasted. Explosive in the blasting holes is then detonated in a single round for explosively expanding formation within the lift downwardly toward the void space provided in the undercut.

In such a separate lift method, measurements can be taken after each lift is blasted for determining whether the top of the fragmented mass being formed is reasonably level. If the top of the fragmented mass is not level, corrective action can be taken in the blasting designs used in expanding one or more succeeding lifts for providing a reasonably level top surface in the resulting fragmented mass. For example, if the fragmented mass is found to be mounding in the center, i.e., its corners are depressed, after a lift as been blasted, a different blasting pattern can be used in blasting the next lift so that rock movement tends to be toward the corners of the retort which can level the resulting fragmented mass.

In an alternative embodiment, the zone of unfragmented formation 32' can be explosively expanded by dynamic expansion techniques with short time delays between lifts, i.e., time delays of fraction of a second. According to such a dynamic expansion technique, a deck loading method is used in which explosive is loaded in the blasting holes 44 so that each blasting hole contains a plurality of explosive charges separately primed for detonation at different times. The deck loading of explosive can extend for substantially the entire height of the zone of unfragmented formation being expanded. Explosive is deck loaded in each blasting hole by placing a separate vertical column of explosive within each lift to be expanded, and by separating adjacent explosive charges within the same blasting hole by stemming. Thus, an array of explosive charges is distributed across the horizontal cross-section of the each lift to be expanded, and the explosive charges in adjacent lifts are separated by stemming. The charges of explosive in each lift are detonated in a single round of explosions for explosively expanding formation in each lift. Each lift is blasted before the next lift is blasted, and explosive in such lifts is detonated in a single round with a time delay between adjacent lifts for explosively expanding the lifts downwardly toward the undercut in an upwardly progressing time delay sequence within the retort site for forming the fragmented mass 30.

Figure 8:
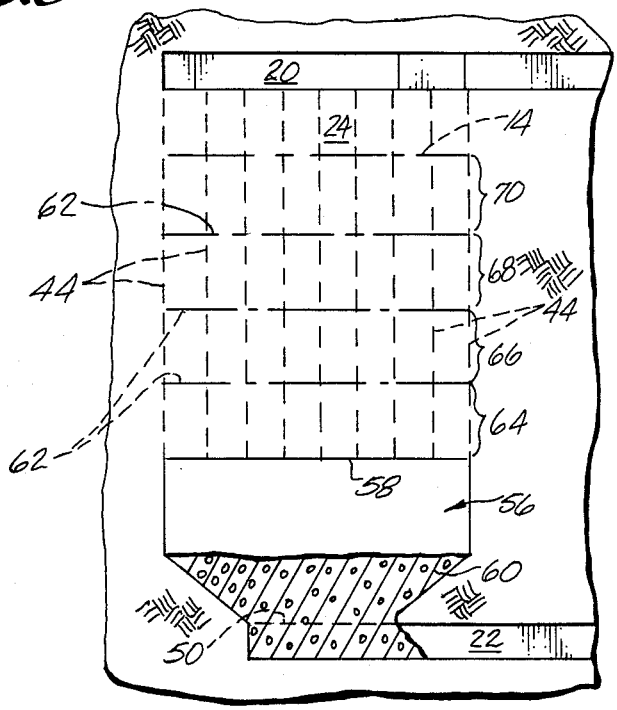
FIG. 8 is a fragmentary, semi-schematic vertical cross-section showing a stage of development in which the undercut has been enlarged.

Referring to FIG. 8, detonation of explosive in the lowermost lift or deck 64 is initiated first to blast the lift downwardly toward the unlimited void volume provided in the undercut. Initiation of the explosive in subsequent lifts is delayed such that a separate new horizontal free face is formed after each lift is blasted, but the time delay is sufficiently short after formation of such a new free face that formation particles produced when blasting each lift are not allowed to expand to the maximum void fraction achieved upon free expansion. Stated another way, the deck loads of explosive are detonated in a single round of explosions wherein the time delay between detonation of explosive in one lift and explosive in an adjacent lift is more than the time required for creation of a free face by explosive expansion of formation by detonation of the first of the adjacent lifts, but the same time delay is less than the time required for allowing free expansion of formation within the first of the adjacent lifts. Expansion of formation within the second of the adjacent lifts is with a sufficiently short time delay that such expansion of formation within the second lift can limit free expansion of formation particles expanded in the first of the adjacent lifts. A desirable time delay between expansion of adjacent lifts is from approximately 1 to 3 milliseconds per foot of burden.

Such dynamic bulking techniques tend to keep the average void fraction within the resulting fragmented mass lower than the average void fraction in a fragmented mass expanded by the separate lift method.

In an alternative embodiment, the deck-loading system can be used for blasting all layers of formation within the retort site in lifts, except for the uppermost layer which can be separately blasted after the void space toward which it is blasted is first measured to provide a desired void fraction and the desired bulking full at the top of the fragmented mass.

FIG. 9 illustrates a technique for explosively expanding the zone of unfragmented formation 32' in lifts so that void fraction gradient within the fragmented mass being formed can be reasonably controlled. According to this method, formation within the zone of unfragmented formation is explosively expanded downwardly in lifts of progressively reduced thickness as the time delay sequence of blasting lifts progresses upwardly in the retort site. A lowermost horizontal layer of formation 72 of generally uniform thickness is explosively expanded downwardly first, followed by a followed by explosively expanding progressively thinner layers of formation 73, 74 and 75 respectively. It can be desirable to explosively expand the progressively thinner layers of formation using dynamic expansion techniques similar to those described above. That is, explosive within the blasting holes 44 is deck loaded in each layer being expanded, with each layer having an array of vertical column charges of explosive distributed across its horizontal cross-section. The explosive in each layer is detonated in a separate single round of explosions, and the separate layers are explosively expanded in an upwardly progressing time delay sequence. A new free face is formed following expansion of each lift, and the next lift in the time delay sequence is explosively expanded before formation particles from expansion of the previous lift expand to their free bulking factor, i.e., the extent of expansion into an unlimited void. Since the layers being expanded are progressively thinner as expansion progresses upwardly into the deposit away from the principal free face 58, for each subsequent layer being expanded, a smaller amount of formation is expanded; but there is progressively less void space to be expanded into, and the void fraction distribution along the height of the resulting fragmented mass can tend to remain reasonably constant. As the layers of formation being expanded progress upwardly, they are loaded with progressively less explosive to provide a substantially constant powder factor among the lifts being expanded.

Referring again to FIG. 8, one or more lifts within the zone 32' of unfragmented formation can be explosively expanded after first initiating pre-splitting charges at the perimeter of such a lift. According to this technique, pre-splitting charges can be placed in one or more rows of blasting holes along one or more side boundaries at perimeter of the zone of unfragmented formation being expanded. The amount of explosive in the pre-splitting charges is less than the amount of explosive in primary charges in the blasting holes within the principal portion of each lift of the zone being expanded. In one embodiment, about one-half as much explosive is used for the pre-splitting charges as is used in the primary charges. The pre-splitting charges can be placed in the four rows of blasting holes along the four side boundaries at the perimeter of the zone 32' of unfragmented formation. A separate set of pre-splitting charges is detonated at the side boundaries of each lift being expanded.

These pre-splitting charges are initiated first to fracture or separate formation within such a layer from the adjoining unfragmented formation, and a short time delay afterwards, formation within the layer itself is blasted by initiating the primary charges. Formation within the entire zone of unfragmented formation is explosively expanded in a upwardly progressing time delay sequence by first initiating pre-splitting charges at the perimeter of a given layer of formation, and thereafter detonating explosive within the pre-split layer of formation, and alternating these steps in an upwardly progressing time delay sequence. It is desirable to use dynamic expansion techniques coupled with the pre-splitting techniques, wherein pre-splitting and blasting of the respective layers are carried out with short time delays in a single round of explosions although the pre-splitting techniques also can be used in a separate lift method similar to that described above. The pre-splitting techniques can decouple the principal blasting forces from adjacent unfragmented formation and assist in fragmentation of formation near the side boundaries of the retort. Pre-splitting can facilitate keeping the overall void fraction in the resulting fragmented mass reasonably uniform. The smaller perimeter charges also can minimize mounding in the center of the fragmented mass when explosively expanding formation downwardly toward the unlimited void volume.

Figure 10:
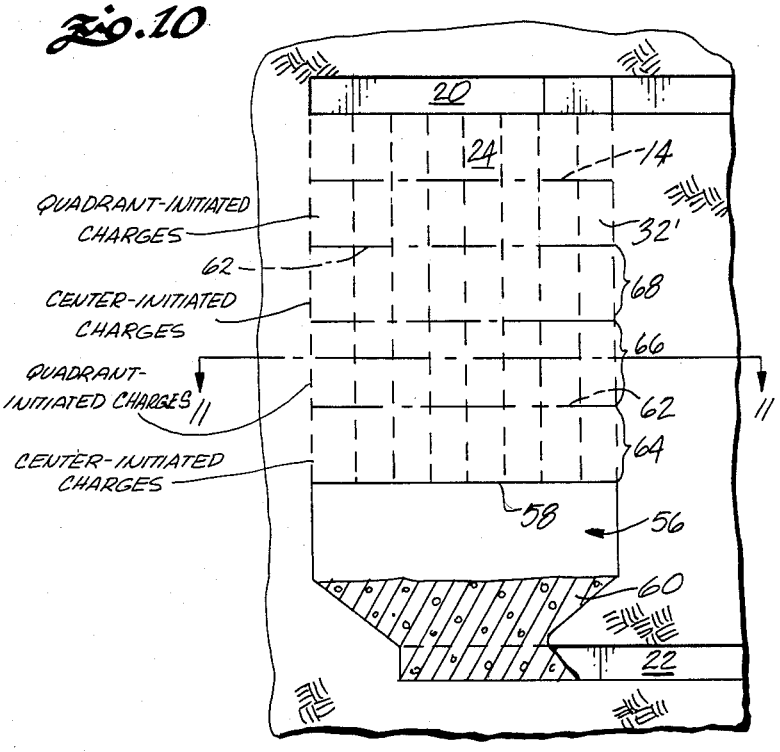
FIG. 10 is a fragmentary, semi-schematic vertical cross-section showing an alternative method of explosively expanding formation within the retort site in which locations of explosive initiation differs from one lift to another.

FIG. 10 illustrates techniques for explosively expanding the zone 32' of unfragmented formation in lifts by differing the location or locations where detonation of explosive is initiated in one lift compared to an adjacent lift. In the illustrated embodiment, center-initiated layers are alternated with quadrant-initiated layers. In a center-initiated layer, detonation of explosive within a given lift is initiated in one or more explosive charges at or near the center of the lift. The remaining explosive charges within the lift are then detonated in a single round in a desired time delay sequence progressing outwardly from such center initiation. Thus, for example, a few charges near the center of the array of blast holes are detonated at a first moment and a short time later, for example 25 milliseconds, charges in a surrounding band of blast holes are detonated. Successive bands are detonated with short time intervals between bands progressing outwardly from the center toward the side boundaries of the retort.

Figure 11:
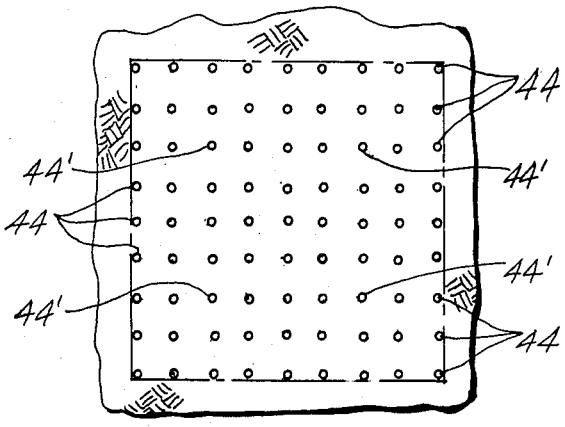
FIG. 11 is a fragmentary, semi-schematic horizontal cross-section taken on line 11—11 of FIG. 10 for illustrating quadrant-initiated charges.

FIG. 11 illustrates a quadrant-initiated blasting technique in which the horizontal cross-section of a layer of formation being expanded is separated into quadrants, and detonation of explosive is initiated substantially simultaneously in one or more explosive charges at or near the center of each quadrant. The remaining explosive charges within the lift are detonated in a single round after such quadrant initiation. In the quadrant-initiated pattern illustrated in FIG. 11, explosive charges in separate blasting holes 44' at the center of each quadrant are detonated at or about the same time, with explosive in the remaining blasting holes being detonated thereafter in a time delay sequence progressing outwardly from the center of each quadrant. The quadrant-initiated blasting pattern is exemplary since other blasting patterns can be used for differing the locations from one lift to the next at which detonation of explosive is initiated. By alternating center-initiated expansion with quadrant-initiated expansion, any tendency of center initiated expansion to cause mounding in the center of the fragmented mass is counteracted by the subsequent quadrant-initiated expansion, which can cause rock movement which tends to fill the corners of the retort. This can produce a reasonably level top surface of the fragmented mass as the fragmented mass is being formed, and produce reasonably uniform lateral void fraction distribution across the fragmented mass.

The alternating blasting pattern shown in FIGS. 10 and 11 is desirable for use with the dynamic expansion method, although it can be used with the separate lift method.

Whether the separate lift method or the dynamic expansion method is used, the delay intervals within a given lift should be reasonably short, i.e., zero to two milliseconds per foot of spacing between blasting holes, or, stated another way, expansion should be in a single round of explosions, so the lift will tend to act as a layer or beam of highly fractured rock. This can produce reasonably low void fractions, i.e., below about 30%, as opposed to longer time delays which can cause more mixing of formation particles and higher void fractions approaching the void fraction characteristic of free expansion.

The two-level mining system described herein can reduce mining costs when compared with a mining system in which on or more intermediate level voids are excavated in a retort site, and formation is expanded toward such multiple voids, and in which such multiple voids are used for access for explosive loading or removal of fragmented formation particles. Safety hazards involved due to personnel working under large unsupported areas within a retort site also are avoided by the two-level mining system herein described in which explosive loading and measuring to determine void volume prior to expansion of each lift are carried out by personnel working in the upper base of operation.

Following explosive expansion for forming the fragmented mass 30 illustrated in FIG. 12, retorting operations are conducted within the fragmented mass by initially igniting formation particles at the top of the fragmented mass to establish a combustion zone at the top of the fragmented mass. Air or other oxygen-supplying gas supplied to the combustion zone from the air level drift or base of operation through vertical air passages 76 sustains the combustion zone and advances it downwardly through the fragmented mass. Combustion gas produced in the combustion zone passes through the fragmented mass to establish a retorting zone on the advancing side of the combustion zone wherein kerogen in the fragmented mass is converted to liquid and gaseous products. As the retorting zone moves down through the fragmented mass, liquid and gaseous products are released from the fragmented formation particles. A sump in the portion of the production level drift 22 beyond the fragmented mass collects liquid products, namely, shale oil 80 and water 81, produced during operation of the retort. A water withdrawal line 82 extends from near the bottom of the sump out through a sealed opening in a bulkhead 84 sealed across the production level drift. The water withdrawal line is connected to a water pump 86. An oil withdrawal line 88 extends from an intermediate level of the sump out through a sealed opening in the bulkhead and is connected to an oil pump 90. The water and oil pumps can be operated manually or by automatic controls (not shown) to remove shale oil and water separately from the sump. Off gas is withdrawn from behind the bulkhead by an off gas line 92 sealed through the bulkhead and connected to a blower 94.

Thus, a method is provided which permits accurate control over the void fraction of the fragmented mass as a fragmented mass is being formed in an upwardly progressing sequence. The method can be used as a two-level system, i.e., a mining system with separate drifts or void spaces formed above and below formation within the retort site, independently of the need for other voids and corresponding retort level access drifts at intermediate levels of the retort site. In the present invention, the upper level drift or void space serves as an upper base of operation for explosive loading and for controlling formation of the fragmented mass, while also serving as an air level void during production. The lower level drift serves as a means for access to a lower region of the retort site for forming the fragmented mass, it serves as a means for withdrawing formation particles during formation of the fragmented mass, and it provides a product level drift during retorting operations. The two-level system provides a means for controlling the void fraction distribution within the fragmented mass so that a reasonably uniformly distributed void fraction can be provided, while also reducing mining and construction costs involved in forming the fragmented mass when compared with systems having one or more intermediate level void and drift systems. The two-level mining system can eliminate presence of workers in a large unsupported area within the retort site during mining operations.

What is claimed is:

1. A method for forming an in situ oil shale retort within a retort site in a subterranean formation containing oil shale, such an in situ oil shale retort containing a fragmented permeable mass of formation particles containing oil shale formed within upper, lower and side boundaries of an in situ oil shale retort site, the method comprising the steps of:

excavating an undercut in a lower portion of the retort site, leaving a zone of unfragmented formation remaining within the retort site above the undercut, said zone of formation having a free face above the undercut, the undercut providing a void space toward which formation within the zone of unfragmented formation is explosively expanded for forming a fragmented mass within the upper, lower and side boundaries of the retort site, the volume of said undercut being substantially similar to the volume of the voids interspersed within the principal portion of the fragmented mass being formed with said boundaries of the retort site;

placing explosive in separate generally horizontal layers of formation within the zone of unfragmented formation; and detonating such explosive in a single round for explosively expanding such layers downwardly toward the undercut in lifts in a plurality of sequential horizontal layers progressing upwardly from the bottom of said zone of unfragmented formation adjacent the undercut to adjacent the upper boundary of the retort site for forming a fragmented permeable mass of formation particles containing oil shale within said boundaries of the in situ oil shale retort; and in which the layers being expanded in lifts are progressively reduced thickness as the sequence of explosions progresses upwardly from one layer to the next.

2. The method according to claim 1 in which the time delay between detonation of explosive in one such horizontal layer of formation and an adjacent horizontal layer of formation is greater than the time required for forming a new free face by explosive expansion of the first of such adjacent horizontal layers of formation, but is less than the time required for permitting essentially free expansion of formation explosively expanded downwardly from the first of said horizontal layers.

3. A method for forming an in situ oil shale retort within a retort site in a subterranean formation containing oil shale, such an in situ oil shale retort containing a fragmented permeable mass of formation particles containing oil shale within upper, lower and side boundaries of the retort site, the method comprising the steps of:

excavating an undercut in a lower portion of the retort site, leaving a zone of unfragmented formation remaining within the retort site above the undercut, the volume of the void space within the undercut being substantially similar to the volume of the voids interspersed within the principal portion of the fragmented mass being formed within said boundaries of the retort site; and placing explosive within the zone of formation and detonating such explosive for explosively expanding the zone of formation downward toward the undercut in lifts comprising a plurality of sequential horizontal layers progressing upwardly from the bottom of the zone of unfragmented formation adjacent the undercut to adjacent the upper boundary of the retort site, said layers being of progressively reduced thickness in an upwardly progressing sequence, for forming a fragmented permeable mass of formation particles containing oil shale within the retort site.

4. The method according to claim 3 in which such explosive is detonated in a single round of explosions.

5. The method according to claim 3 including the steps of placing explosive in a lower layer of formation, detonating explosive placed in such a lower layer, and thereafter placing explosive in an adjacent upper layer and detonating such explosive in the upper layer.

6. The method according to claim 3 in which the time delay between detonation of explosive in one such horizontal layer of formation and an adjacent horizontal layer of formation is greater than the time required for forming a new free face by explosive expansion of the first of such adjacent horizontal layers of formation, but is less than the time required for permitting essentially free expansion of formation explosively expanded downwardly from the first of said horizontal layers.

7. A method for forming an in situ oil shale retort within a retort site in a subterranean formation containing oil shale, such an in situ oil shale retort containing a fragmented permeable mass of formation particles containing oil shale formed within upper, lower and generally vertical side boundaries of the retort site, the method comprising the steps of:

excavating an upper level void in such formation adjacent an upper portion of the retort site, the upper level void providing access to substantially the entire horizontal cross-section of the fragmented mass being formed;

excavating an undercut in a lower portion of the retort site adjacent the lower level drift, leaving a zone of unfragmented formation remaining within the boundaries of the retort site above the undercut, the volume provided by the undercut being substantially similar to the volume of the voids interspersed within the principal portion of the fragmented mass being formed;

drilling a plurality of vertical blasting holes in the zone of unfragmented formation from access provided by the upper level void; and placing a plurality of explosive charges in each of the vertical blasting holes within the zone of formation and detonating such explosive charges for explosively expanding the zone of formation in lifts comprising a plurality of sequential horizontal layers having a horizontal cross-section similar to the horizontal cross-section of the fragmented mass being formed, the explosive charges in said horizontal layers being detonated sequentially from the bottom up, wherein detonation of explosive within a first one of said layers is initiated at a first horizontal location within such a first layer, and detonation of explosive within an adjacent second of such layers is initiated at a second horizontal location that is different from said first horizontal location, for forming a fragmented permeable mass of formation particles containing oil shale in an in situ oil shale retort.

8. The method according to claim 7 wherein detonation of explosive in such a first layer is generally center-initiated, and detonation of explosive in said second layer is initiated at one or more locations spaced from the center of the second layer.

9. The method according to claim 7 wherein detonation of explosive in said first layer is generally center-initiated, and detonation of explosive in said second layer is generally quadrant-initiated.

10. The method according to claim 7 in which the time delay between detonation of explosive in one such horizontal layer of formation and an adjacent horizontal layer of formation is greater than the time required for forming a new free face by explosive expansion of the first of such adjacent horizontal layers of formation, but is less than the time required for permitting essentially free expansion of formation explosively expanded downwardly from the first of said horizontal layers.

11. A method for forming an in situ oil shale retort within a retort site in a subterranean formation containing oil shale, such an in situ shale retort containing a fragmented permeable mass of formation particles containing oil shale formed within upper, lower and side boundaries of the retort site, the method comprising the steps of:

excavating an undercut in unfragmented formation within a lower portion of the retort site, leaving a zone of unfragmented formation remaining within the retort site above the undercut, the volume of the void space within the undercut being substantially similar to the volume of the void spaces interspersed within the principal portion of the fragmented mass being formed within said boundaries of the retort site;

placing explosive in the zone of unfragmented formation; and detonating such explosive for explosively expanding the zone of formation downwardly toward the undercut in lifts in a plurality of sequential horizontal layers progressing upwardly from the bottom of the zone of unfragmented formation adjacent the undercut to adjacent the upper boundary of the retort site for forming a fragmented permeable mass of formation particles containing oil shale within the boundaries of the retort site, wherein said sequential horizontal layers of formation extend across the width of the retort site and have a substantially greater width than the height of such horizontal layer, at least a portion of such horizontal layers being explosively expanded downwardly toward an essentially unlimited void volume, the void volume of the undercut prior to detonation of such explosive being greater than about 30% to 35% of the volume within said zone of unfragmented formation being expanded, wherein said sequential horizontal layers are explosively expanded with a time delay sequence between adjacent layers of formation, and wherein the time delay between detonation of explosive in one such horizontal layer of formation and an adjacent horizontal layer of formation is greater than the time required for forming a new free face by explosive expansion of the first of the adjacent horizontal layers of formation, but is less than the time required for permitting essentially free expansion of formation explosively expanded downwardly from the first of said horizontal layers.

12. A method as recited in claim 11 wherein each layer before the last layer is explosively expanded downwardly toward an essentially unlimited void.

13. The method according to claim 11 in which the horizontal cross-section of the undercut is substantially coextensive with the horizontal cross-section of the fragmented mass being formed.

14. The method according to claim 11 including forming the undercut by explosively expanding unfragmented formation within a lower portion of the retort site, and leaving an initial mass of formation particles within a lower portion of the undercut prior to explosively expanding the remaining zone of unfragmented formation in lifts, the void space provided within the undercut extending from the top level of the initial mass of formation particles to a substantially horizontal free face of formation below said remaining zone of unfragmented formation.

15. The method according to claim 14 including withdrawing particles from the initial fragmented mass to provide a top level of the initial fragmented mass substantially parallel to said horizontal free face prior to explosively expanding the remaining zone of unfragmented formation.

16. The method according to claim 11 in which blasting holes are drilled downwardly in the zone of unfragmented formation and explosive is placed in a lower portion of such blasting holes.

17. The method according to claim 16 in which such explosive is placed in said plurality of sequential horizontal layers of formation within the remaining zone of unfragmented formation; and such explosive is detonated in a single round of explosions with a sequence progressing upwardly in said remaining zone of unfragmented formation.

18. The method according to claim 16 including placing explosive in a lower layer of formation, detonating the explosive placed in the lower layer, and thereafter placing explosive in an adjacent upper layer of formation, and detonating the explosive placed in the upper layer.

19. A method for forming an in situ oil shale retort within a retort site in a subterranean formation containing oil shale, such an in situ oil shale retort containing a fragmented permeable mass of formation particles containing oil shale formed within upper, lower and side boundaries of the retort site, the method comprising the steps of:

excavating an undercut in a lower portion of the retort site, leaving a zone of unfragmented formation remaining within the retort site above the undercut, said zone of unfragmented formation having a free face above the undercut;

drilling blasting holes into the zone of unfragmented formation above the undercut;

placing explosive in the blasting holes in separate generally horizontal layers of formation within the zone of unfragmented formation above the undercut; and detonating such explosive in a single round for explosively expanding such layers downwardly toward the free face in lifts in a plurality of sequential horizontal layers progressing upwardly from the bottom of the zone of unfragmented formation adjacent the undercut to adjacent the upper boundary of the retort site for forming a fragmented permeable mass of formation particles containing oil shale within said boundaries of the in situ oil shale retort site, wherein said sequential horizontal layers of formation extend across the width of the retort site and have a substantially greater width than the height of such horizontal layer, the volume of the void space within the undercut prior to such explosive expansion being similar to the volume of the voids interspersed within the principal portion of said fragmented mass formed within said boundaries following such explosive expansion, wherein said sequential horizontal layers are explosively expanded with a time delay sequence between adjacent layers of formation, and wherein the time delay between detonation of explosive in one such horizontal layer of formation and an adjacent horizontal layer of formation is greater than the time required for forming a new free face by explosive expansion of the first of the adjacent horizontal layers of formation, but is less than the time required for permitting essentially free expansion of formation explosively expanded downwardly from the first of said horizontal layers.

20. The method according to claim 19 including the steps of excavating an upper level void in such formation adjacent an upper portion of the retort site, the upper level void providing access to substantially the entire horizontal cross-section of the undercut; drilling a plurality of substantially vertical blasting holes in the zone of formation from access provided by the upper level void; and loading such blasting holes with separate columns of vertically spaced apart explosive charges corresponding to the separate layers of formation being expanded in lifts.

21. The method according to claim 6 wherein the void volume in the undercut is sufficient that at least a portion of the horizontal layers expand towards an essentially unlimited void.

22. a method for forming an in situ oil shale retort within a retort site in a subterranean formation containing oil shale, such an in situ oil shale retort containing a fragmented permeable mass of formation particles containing oil shale formed within upper, lower and side boundaries of the retort site, the method comprising the steps of:

excavating an undercut in a lower portion of the retort site, leaving a zone of unfragmented formation remaining within the retort site above the undercut, said zone of unfragmented formation having a free face above the undercut;

drilling blasting holes into the zone of unfragmented formation above the undercut;

placing explosive in the blasting holes in separate generally horizontal layers of formation within the zone of unfragmented formation above the undercut; and detonating such explosive in a single round for explosively expanding such layers downwardly toward the free face in lifts in a plurality of sequential horizontal layers progressing upwardly from the bottom of the zone of unfragmented formation adjacent the undercut to adjacent the upper boundary of the retort site for forming a fragmented permeable mass of formation particles containing oil shale within said boundaries of the in situ oil shale retort site, the volume of the void space within the undercut prior to such explosive expansion being similar to the volume of the voids interspersed within the principal portion of said fragmented mass formed within said boundaries following such explosive expansion, the void volume in the undercut being sufficient that at least a portion of the horizontal layers expands towards an essentially unlimited void, and in which the layers being expanded in lifts are of progressively reduced thickness as the sequence of explosions progresses upwardly from one layer to the next.

23. The method according to claim 22 in which the time delay between detonation of explosive in one such horizontal layer of formation and an adjacent horizontal layer of formation is greater than the time required for forming a new free face by explosive expansion of the first of such adjacent horizontal layers of formation, but is less than the time required for permitting essentially free expansion of formation explosively expanded downwardly from the first of said horizontal layers.

24. A method for forming an in situ oil shale retort within a retort site in a subterranean formation containing oil shale, such an in situ oil shale retort containing a fragmented permeable mass of formation particles containing oil shale formed within upper, lower and side boundaries of the retort site, the method comprising steps of:

excavating an undercut in a lower portion of the retort site adjacent the lower level drift, leaving a zone of unfragmented formation remaining within the retort site above the undercut, the volume of the void space within the undercut being substantially similar to the volume of the voids interspersed within the principal portion of the fragmented mass being formed within said boundaries of the retort site; and placing explosive within the zone of unfragmented formation and detonating such explosive for explosively expanding the zone of unfragmented formation downwardly toward the undercut in lifts comprising a plurality of sequential horizontal layers progressing upwardly from the bottom of the zone of unfragmented formation adjacent the undercut to adjacent the upper boundary of the retort site, said layers being of progressively reduced thickness in an upwardly progressing sequence and the void volume available for expansion of at least a portion of such layers being sufficient for explosively expanding such layer toward an essentially unlimited void volume, for forming a fragmented permeable mass of formation particles containing oil shale within said boundaries of the retort site.

25. The method according to claim 24 in which such explosive is detonated in single round of explosions.

26. The method according to claim 24 including the steps of placing explosive in a lower layer of formation, detonating explosive placed in such a lower layer, and thereafter placing explosive in an adjacent upper layer and detonating such explosive in the upper layer.

27. The method according to claim 24 in which the time delay between detonation of explosive in one such horizontal layer of formation and an adjacent horizontal layer of formation is greater than the time required for forming a new free face by explosive expansion of the first of such adjacent horizontal layers of formation, but is less than the time required for permitting essentially free expansion of formation explosively expanded downwardly from the first of said horizontal layers.

28. A method for forming an in situ oil shale retort within a retort site in a subterranean formation containing oil shale, such an in situ oil shale retort containing a fragmented permeable mass of formation particles containing oil shade within upper, lower and side boundaries of the retort site, the method comprising the steps of:

excavating an undercut in a lower portion of the retort site, leaving a zone of unfragmented formation remaining within the retort site above the undercut, the volume of the void space within the undercut being substantially similar to the volume of the voids interspersed within the principal portion of the fragmented mass being formed within said boundaries of the retort site; and placing explosive within the zone of unfragmented formation and detonating such explosive for explosively expanding the zone of formation downward toward the undercut in lifts comprising a plurality of sequential horizontal layers progressing upwardly from the bottom of the zone of unfragmented formation adjacent the undercut to adjacent the upper boundary of the retort site, said layers being of progressively reduce thickness in an upwardly-progressing sequence, for forming a fragmented permeable mass of formation particles containing oil shale within the retort site, and in which the void volume of the undercut prior to detonation of such explosive is sufficient for substantially free expansion of formation particles toward said undercut from a plurality of said horizontal layers above the undercut.

29. The method according to claim 28 including withdrawing the particles from the initial fragmented mass to provide said top level of the initial fragmented mass substantially parallel to said horizontal free face prior to explosively expanding the principal zone of unfragmented formation.

30. The method according to claim 29 in which the void volume of the undercut prior to detonation of such explosive in the principal zone of unfragmented formation is sufficient for substantially free expansion of formation particles toward said undercut from a plurality of said horizontal layers above the undercut.

31. The method according to claim 28 in which the time delay between detonation of explosive in one such horizontal layer of formation and an adjacent horizontal layer of formation is greater than the time required for forming a new free face by explosive expansion of the first of such adjacent horizontal layers of formation, but is less than the time required for permitting essentially free expansion of formation explosively expanded downwardly from the first of said horizontal layers.

* * * * *